US009748715B2

(12) United States Patent
Wang et al.

(10) Patent No.: US 9,748,715 B2
(45) Date of Patent: Aug. 29, 2017

(54) MODULAR SOCKET PANEL AND LAYER MODULE FOR MODULAR SOCKET PANEL

(71) Applicant: Sipomac Technology Company Limited, Kowloon (HK)

(72) Inventors: Sai Man Wang, Kowloon (HK); Sek Un Fong, Kowloon (HK)

(73) Assignee: Sipomac Technology Company Limited, Kowloon (HK)

( * ) Notice: Subject to any disclaimer, the term of this patent is extended or adjusted under 35 U.S.C. 154(b) by 0 days.

(21) Appl. No.: 14/938,210

(22) Filed: Nov. 11, 2015

(65) Prior Publication Data

US 2016/0134062 A1 May 12, 2016

(30) Foreign Application Priority Data

Nov. 11, 2014 (CN) ..... 2014 1 0631702

(51) Int. Cl.

| | |
|---|---|
| ***H01R 13/60*** | (2006.01) |
| ***H01R 24/78*** | (2011.01) |
| ***H01R 31/00*** | (2006.01) |
| ***H01R 31/06*** | (2006.01) |
| *H01R 13/70* | (2006.01) |
| *H01R 24/64* | (2011.01) |

(52) U.S. Cl.

CPC ..... *H01R 24/78* (2013.01); *H01R 31/005* (2013.01); *H01R 31/06* (2013.01); *H01R 13/701* (2013.01); *H01R 24/64* (2013.01)

(58) Field of Classification Search

CPC H01R 13/652; H01R 13/6395; H01R 25/006; H01R 23/025; H02G 3/20; H02G 3/14; H02G 3/088; H02G 3/18; H02G 3/123

USPC ..... 439/107, 373, 535–538; 220/241, 242; 174/50, 53, 58, 66, 67

See application file for complete search history.

(56) References Cited

U.S. PATENT DOCUMENTS 3,609,647 A * 9/1971 Castellano ..... H02G 3/16 174/53
5,015,203 A * 5/1991 Furrow ..... H01R 13/743 439/535

(Continued)

FOREIGN PATENT DOCUMENTS

CN 201266760 7/2009
CN 204615090 9/2015

(Continued)

*Primary Examiner* — Thanh Tam Le
(74) *Attorney, Agent, or Firm* — Wells St. John P.S.

(57) ABSTRACT

The present invention discloses a modular socket panel which includes a bottom layer adapted to be fixed to an embedded case in a wall and adapted to be electrically connected to a power supply provided by the embedded case, and a surface layer adapted to be directly or indirectly connected to the bottom layer in a non-fastening manner. The surface layer provides a power socket, which is electrically connected to the bottom layer. The modular socket panel disclosed in the present invention enables a user to mount a middle layer and the surface layer onto the bottom layer or remove the middle layer and surface layer from the bottom layer without any tool, and also enables the user to mount different middle layers in the modular socket panel when needed to implement different functions, for example adding more intelligent functions.

11 Claims, 7 Drawing Sheets

(56) References Cited

U.S. PATENT DOCUMENTS

| | | | | |
|---|---|---|---|---|
| 5,848,907 | A | 12/1998 | Chen | |
| 6,095,850 | A * | 8/2000 | Liu | G01R 13/02 439/488 |
| 6,939,179 | B1 * | 9/2005 | Kieffer, Jr. | H01R 13/514 439/650 |
| 6,945,815 | B1 * | 9/2005 | Mullally | H01H 1/5866 439/180 |
| 7,160,147 | B1 * | 1/2007 | Stephan | H01R 9/24 174/60 |
| 7,425,677 | B2 * | 9/2008 | Gates | H01R 13/508 174/481 |
| 7,569,771 | B2 * | 8/2009 | Nicholson | H02G 3/18 174/481 |
| 8,287,305 | B2 * | 10/2012 | Sil | H01R 13/443 439/535 |
| 8,348,683 | B2 * | 1/2013 | Row | H02G 3/12 174/66 |
| 8,415,561 | B2 * | 4/2013 | Gates | H01R 13/508 174/481 |
| 8,864,507 | B2 * | 10/2014 | Row | H01R 25/006 174/66 |
| 8,912,442 | B2 * | 12/2014 | Smith | H02G 3/14 174/66 |

FOREIGN PATENT DOCUMENTS

| | | |
|---|---|---|
| GB | 1422428 | 1/1976 |
| GB | 2438001 | 11/2007 |
| GB | 2469223 | 10/2010 |
| GB | 1519547.2 | 4/2016 |

* cited by examiner

MODULAR SOCKET PANEL AND LAYER MODULE FOR MODULAR SOCKET PANEL

RELATED PATENT DATA

This application claims priority to Chinese Patent Application Serial No. 201410631702.X filed Nov. 11, 2014, titled "Modular Socket Panel and Layer Module for Modular Socket Panel", the teachings of which are incorporated herein by reference.

FIELD OF THE INVENTION

The present invention relates to an electrical connector, and in particular to a device mounted in indoor environments such as residential buildings or office buildings, and configured to supply power to electrical appliances.

BACKGROUND OF THE INVENTION

Socket panels are commonly seen on walls of residential rooms or office rooms, and they are used to supply 110V or 220V mains power to various industrial or domestic electrical appliances via standard sockets. Usually, the surface of socket panels are in white color, so that the socket panels are in tune with surrounding white wall face, and would not violate the room's interior decoration tone. In addition, a socket panel usually consists of two parts: an embedded case (also referred to as bottom case) embedded in the wall and a panel snap-fitted to the embedded case. These two parts are connected by screws.

As technology (especially various communication and electronic devices) advances rapidly, conventional socket panels that only provide AC power supply turn to be not meeting user's demands any more. Besides the basic functions, it is desirable that socket panels can provide other functions, such as network connection and USB interface, etc. In addition, many conventional domestic socket panels keep being worn gradually and have to be replaced, or should be renovated to be in tune with the interior decoration that has been improved rapidly. However, it is still not easy nowadays for ordinary people to replace socket panels, because not only it is a bit dangerous to replace the socket panel (as there is bare electrical wiring), but also the replacement requires tools to accomplish. Conventional designs of socket panels make the replacement difficult and render limitations in their functionality.

SUMMARY OF THE INVENTION

Therefore, the present invention in one aspect discloses a modular socket panel, which contains a bottom layer and a surface layer. The bottom layer is adapted to be fixed to an embedded case in a wall and is adapted to electrically connect to a power supply provided by the embedded case. The surface layer is adapted to be directly or indirectly connected to the bottom layer in a non-fastening manner. The surface layer provides a power socket, which is electrically connected to the bottom layer.

Preferably, the modular socket panel further contains a middle layer disposed between the bottom layer and the surface layer. The middle layer is adapted to connect to the bottom layer in a pull and plug manner. The surface layer is adapted to connect to the middle layer in a pull and plug manner. The middle layer is electrically connected to the bottom layer and the surface layer respectively.

Preferably, the middle layer is provided with at least one of the following components: a environmental sensor, a network adapter, and a controller.

In an exemplary embodiment, the environmental sensor is one of the following sensors: a temperature sensor, a humidity sensor, a human body sensor, an infrared sensor, and a light sensor. The network adapter is a powerline adapter, an Ethernet adapter, and a wireless access point. The controller is adapted to connect with switches disposed on the surface layer, and receive inputs generated by operation on the switches, therefore controls operation of electrical appliances external to the modular socket panel.

In a variation of the embodiments, the bottom layer of the modular socket panel has a plurality of bottom layer jacks, all of which are connected to the power supply provided by the embedded case. The middle layer has a plurality of middle layer pins that are respectively corresponding to and electrically connected to the bottom layer jacks, and a plurality of middle layer jacks connected to the middle layer pins. The surface layer has a plurality of surface layer pins that are respectively corresponding to and electrically connected to the middle layer jacks.

In another variation, the bottom layer of the modular socket panel is directly connected to the surface layer. The bottom layer has a plurality of bottom layer jacks, all of which are connected to the power supply provided by the embedded case. The surface layer has a plurality of middle pins that are respectively corresponding to and electrically connected to the bottom layer jacks.

In one implementation, the power socket of the modular socket panel is a USB socket, which is connected to the bottom layer via an AC to DC converter.

In another implementation, the bottom layer is adapted to be fixed to the embedded case in the wall by screws.

In one variation, the surface of the surface layer is colorful.

In another variation, the front side of the surface layer is in polygonal, round, or irregular shape.

In a further variation, the non-fastening manner by which the middle layer and surface layer are mounted onto the bottom layer includes sliding, pull and plug, or snap-fitting.

In another aspect of the present invention, a layer module for a modular socket panel is disclosed. The layer module is adapted to be mounted in a pull and plug manner onto a bottom layer fixed to an embedded case in a wall. The layer module provides power sockets, which are electrically connected to the bottom layer.

Preferably, the layer module is the outermost surface layer of the modular socket panel.

More preferably, the layer module is a middle layer, which is provided with at least one of the following components: an environmental sensor, a network adapter and a controller.

More preferably, the middle layer is configured to accept a surface layer mounted onto it in a pull and plug manner, and the surface layer is adapted to be electrically connected to the middle layer.

In one variation, the non-fastening manner includes sliding, pull and plug, or snap-fitting.

The modular socket panel provided in the present invention has many advantages. With the detachable design in a pull and plug manner, the user can mount the middle layer and the surface layer onto the bottom layer or remove the middle layer and the surface layer from the bottom layer without using any tool. During the interior decoration, the bottom layer can be pre-mounted on the embedded case in the wall by screws and at the same time the electric wires led out from the embedded case is connected to the bottom layer. Of course, the embedded case can be removed and replaced when necessary at a later time. However, the user usually does not need to consider the installation of the bottom layer, but only has to mount the middle layer and/or the bottom layer in snap-fitting, pull and plug, or sliding manner. Thus, the middle layer or the surface layer can be easily replaced when it is damaged. In addition, the user can easily replace the surface layer with another one with the user's favorable color.

Moreover, a great advantage provided by the present invention is that the middle layer can be easily removed and replaced by the user without any tool or professional electrician's skill. The user can mount different middle layers in the modular socket panel as required to implement different functions, and the manufacturer can provide new middle layers for the users to choose as the market is developing. Thus, the functions of the modular socket panel can be expanded continuously, for example adding more intelligent functions, without replacing the entire modular socket panel.

BRIEF DESCRIPTION OF THE DRAWINGS

The features and advantages of the present invention can be understood further by reading the following description with reference to the accompanying drawings. Among the accompanying drawings, the same component is denoted by the same reference mark. In some cases, a sub-mark is appended to a reference mark by a hyphen to represent a specific one among similar components. A reference mark which is not appended by any specific sub-mark refers to all the similar components.

DETAILED DESCRIPTION

In embodiments of the present invention, there is provided a socket panel structure that can be assembled and disassembled flexibly. Thus, the socket panel is easy to be replaced and maintained, and the function expandability of the socket panel is greatly improved. As a result, the socket panel is able to meet the requirements for intelligent home and intelligent furniture in the future. Other benefits and advantages provided by embodiments of the present invention can be understood easily through reading the following description.

Figure 1:
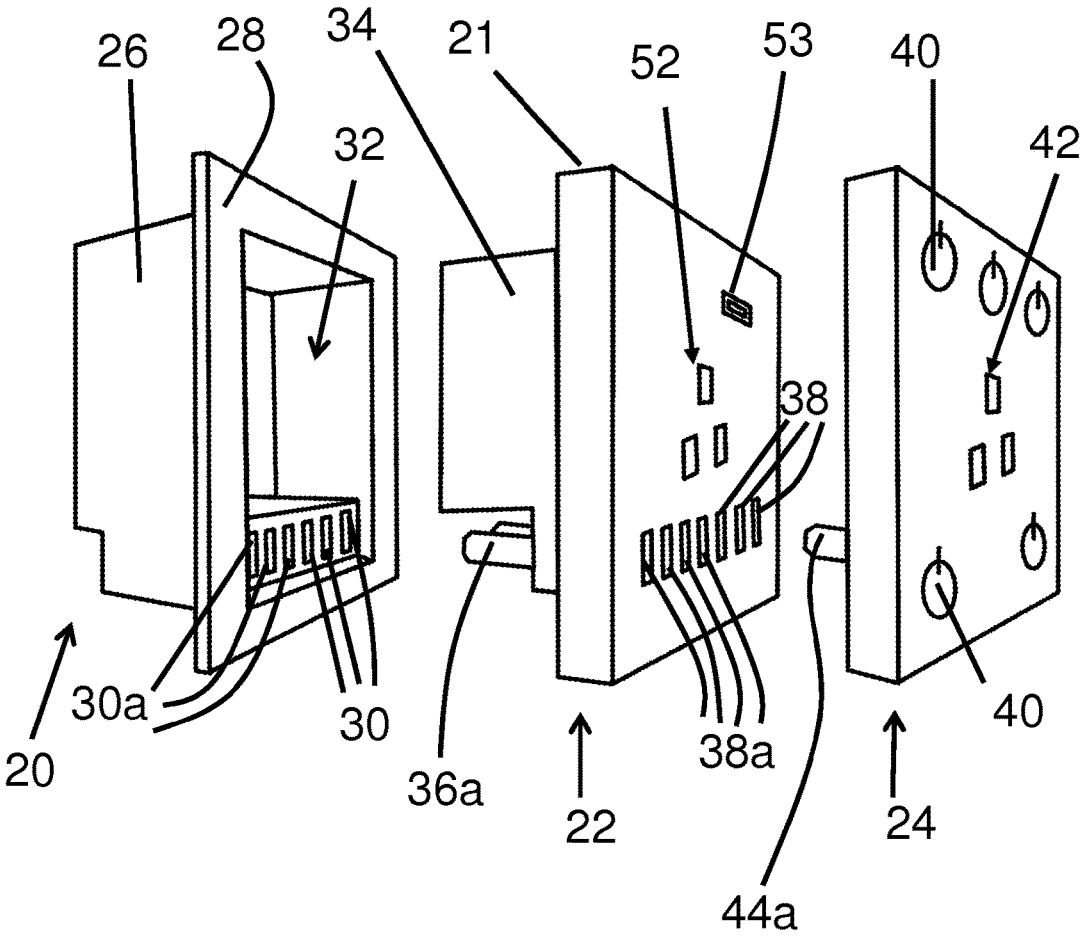
FIG. 1 is a diagram illustrating assembly relationship of the modular socket panel according to an embodiment of the present invention.

Firstly, the modular socket panel according to one embodiment of the present invention is shown in FIG. 1. The modular socket panel contains three parts: a bottom layer 20, a middle layer 22 and a surface layer 24. The bottom layer 20, the middle layer 22, and the surface layer 24 are stacked and mounted together into an assembly in a top-to-bottom sequence by a pull and plug manner. The bottom layer 20, the middle layer 22, and the surface layer 24 are adapted to be detached manually without using any tool as well. The pull and plug way of assembling is accomplished by coupling a plurality of jacks and/or pins of each part accordingly. This will be described in details later hereunder.

The bottom layer 20 is adapted to be fixed to an embedded case (not shown) in the wall. Here, the embedded case includes a conventional bottom case/embedded case mounted in the wall, for example. It is well known to the person skilled in the art that such an embedded case is usually in a rectangular shape, and with an opening on the side facing outward. Electric wires led out from the wall can be connected to the bottom layer 20 outside of the embedded case via the opening, so that the bottom layer 20 is electrically connected to the electric wires (also referred to as power supply herein) in the embedded case. See FIG. 1, FIG. 2*a* and FIG. 2*b*, the bottom layer 20 is a substantially protruding part including a protrusion 26 and a cavity 32 defined in the protrusion 26. The cavity 32 is configured to receive a protrusion 34 of the middle layer 22 as shown in FIG. 1. An outer rim 28 is arranged on the periphery of the protrusion 26, i.e. on the front side of the bottom layer 20. The cross-sectional area defined by the outer rim 28 is greater than the cross-sectional area of the protrusion 26. The outer rim 28 is configured to match the bottom layer 20 with the shape of the embedded case (not shown) and align bottom layer 20 to the embedded case. In addition, in a preferred embodiment, the outer rim 28 has screw holes (not shown), so that the bottom layer 20 can be easily mounted on the embedded case with long screws.

Figures 2A, 2B, 2C:
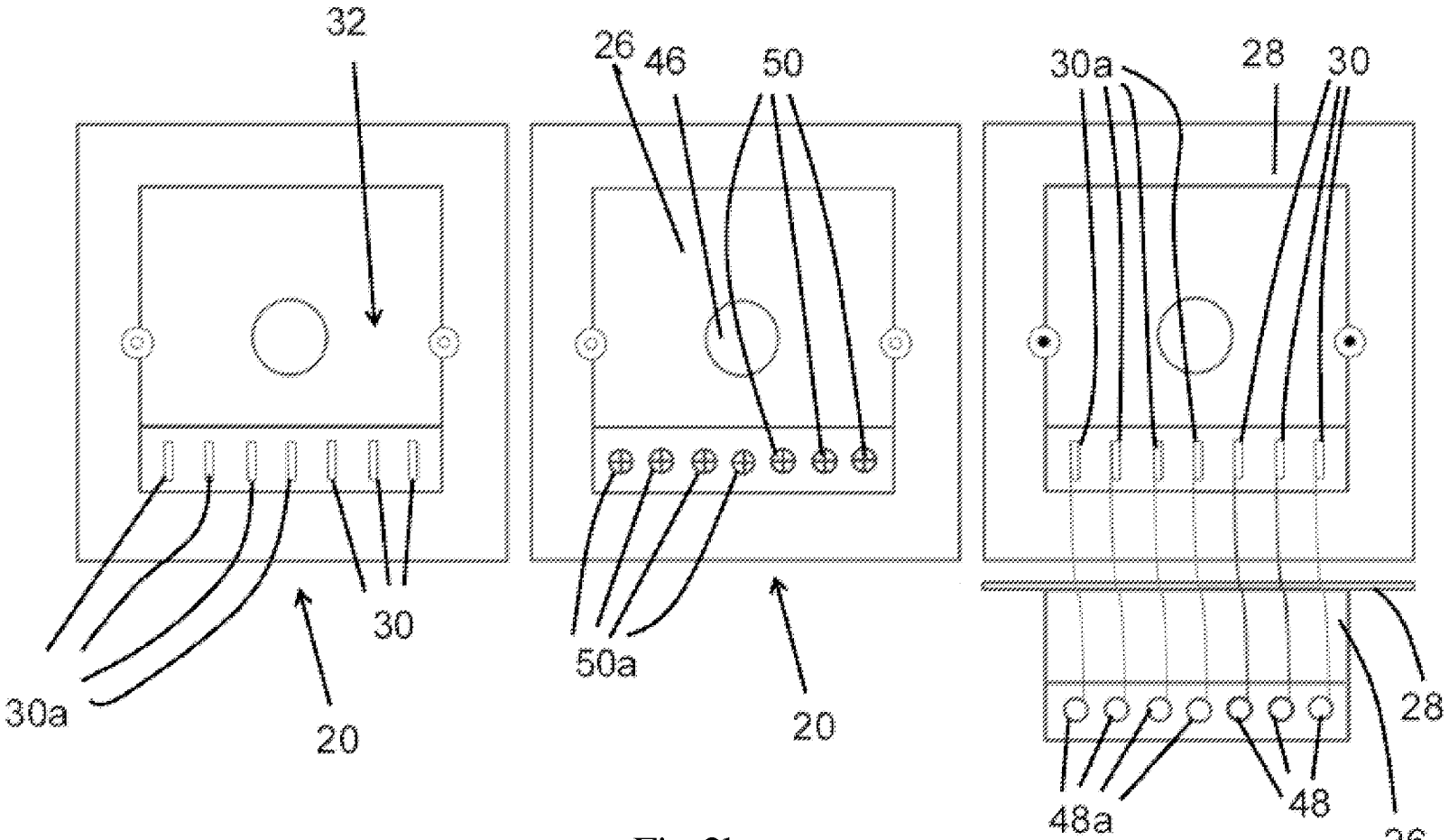
FIG. 2*a* is a front view of the bottom layer in the modular socket panel shown in FIG. 1.
FIG. 2*b* is a rear view of the bottom layer in the modular socket panel shown in FIG. 1.
FIG. 2*c* is a diagram illustrating the wiring of the bottom layer in the modular socket panel shown in FIG. 1, showing the front view and bottom view of the bottom layer.

Moreover, a plurality of bottom layer jacks 30, 30*a* are arranged on the front side of the lower part of the bottom layer 20 (here, the lower part refers to the portion which is lower on the modular socket panel when the modular socket panel is mounted on a vertical wall face). In this embodiment, there are seven bottom layer jacks 30, 30*a* aligned along a straight line and spaced evenly. The difference between the bottom layer jacks 30*a* and the bottom layer jacks 30 is that there are three bottom layer jacks 30 and four bottom layer jacks 30*a*. The bottom layer jacks 30 are electrically connected to the mains power supply led out from the embedded case. In particular, the three bottom layer jacks 30 are connected to the live wire, neutral wire, and earth wire of mains power supply respectively. In addition, the four bottom layer jacks 30*a* are not configured to directly connect to the mains power supply. Instead, the bottom layer jacks 30*a* are configured to connect other electrical appliances (not shown), such as electric lamps, speakers, air conditioners and the like in the room. In other words, the bottom layer jacks 30*a* are configured to control other electrical appliances. Moreover, as shown in FIG. 2*c*, each bottom layer jack 30 is connected to a bottom wiring terminal 48 uniquely corresponding to it, while each bottom layer jack 30*a* is connected to a bottom layer jack 48*a* uniquely corresponding to it. It should be noted that the wirings between the bottom layer jacks 30 and the bottom wiring terminals 48 shown in FIG. 2*c* are provided only to illustrate the connections there between, but are not real fly lines. The bottom layer jacks 30 and the bottom wiring terminals 48 are in fact connected together through internal wirings which are not exposed to the outside of the bottom layer 20 in consideration of aesthetic appearance and safety. As shown in FIG. 2*b*, a row of back wiring terminals 50, 50*a* are arranged along the lower edge of the protrusion 26 on the back side of the bottom layer 20, and these back wiring terminals 50, 50*a* are connected to the bottom wiring terminals 48, 48*a*. FIG. 2*b* also shows the opening 46 on the back side of the bottom layer 20. The opening 46 allows cables other than the mains power wiring from the embedded case, such as network cable, telephone wire, TV cable, CD-ROM drive cable, speaker wire and the like to be connected to the middle layer 22 through it.

Figures 3A, 3B, 3C:
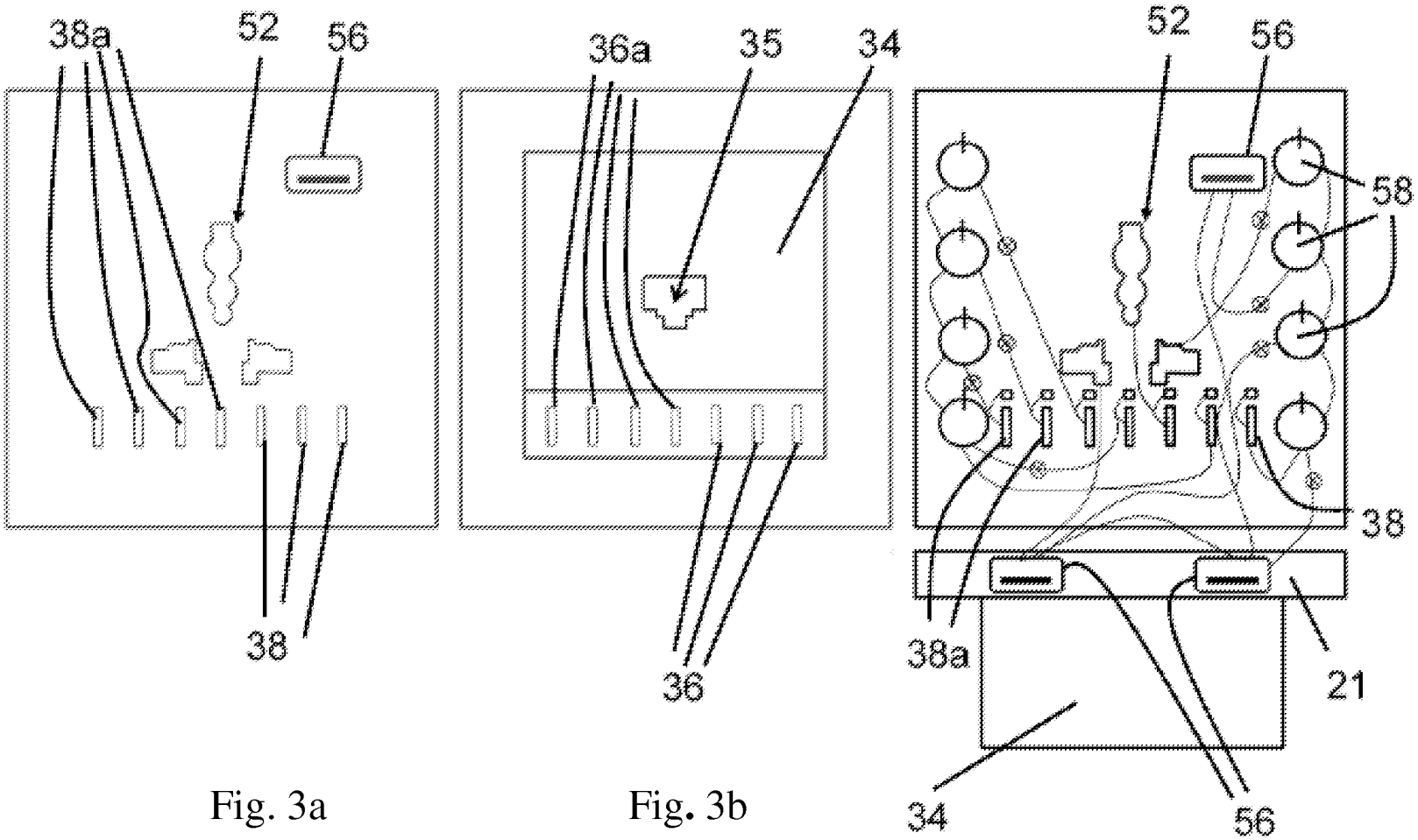
FIG. 3*a* is the front view of the middle layer in the modular socket panel shown in FIG. 1.
FIG. 3*b* is the rear view of the middle layer in the modular socket panel shown in FIG. 1.
FIG. 3*c* is a diagram illustrating the wiring of the middle layer in the modular socket panel shown in FIG. 1, showing the front view and bottom view of the middle layer.

Now, look at the structure of the middle layer 22. Referring to FIG. 1, FIG. 3*a*, and FIG. 3*b*, similar to the bottom layer 20, the middle layer 22 is also a substantially protruding part with a protrusion 34. But what is different from the bottom layer 20 is that the middle layer 22 has no open cavity. A casing 21 is arranged on the periphery of the protrusion 34, i.e., on the front side of the middle layer 22. The cross-sectional area defined by the casing 21 is greater than the cross-sectional area of the protrusion 34. The casing 21 is configured to match the shape of the middle layer 22 with that of the bottom layer 20, and align the middle layer 22 to the bottom layer 20, so that the protrusion 34 of the middle layer 22 is received in the cavity 32 of the bottom layer 20 and the back side periphery of the casing 21 fits closely to the outer rim 28 when the middle layer 22 and the bottom layer 20 are coupled together. In addition, a plurality of middle layer jacks 38, 38*a* are arranged on the front side of the lower part of the middle layer 22. Similar to the configuration of the surface layer, there are seven middle layer jacks 38, 38*a* aligned in a line and spaced at the same interval in this embodiment. The three middle layer jacks 38 of the middle layer 22 are respectively connected to three middle layer pins 36 on the back side of the middle layer 22, while the four middle layer jacks 38*a* are respectively connected to four middle layer pins 36*a* on the back side of the middle layer 22. Here, the concept of the middle layer jacks 38, 38*a* and middle layer pins 36, 36*a* is similar to that of the bottom layer jacks 30, 30*a*. The middle layer jacks 38 and the middle layer pins 36 are respectively corresponding to the live wire, earth wire, and neutral wire of the mains power supply, so that the middle layer 22 obtains power supply and can supply power to the surface layer 24 via the middle layer jacks 38. The middle layer jacks 38*a* and middle layer pins 36*a* are control wirings configured to control other electrical appliances. In addition, a power socket 52 is arranged on the front side of the middle layer 22. Here, the power socket 52 shown in the figure has three jacks arranged in a triangle shape as in British 220V standard.

FIG. 3*c* shows the internal wiring in the middle layer 22. The power socket 52, middle layer jacks 38 and 38*a*, and a plurality of switches 58 disposed at the two sides of the power socket 52, are connected together through wirings. There are eight switches 58 shown in FIG. 3*c*. In this embodiment, three switches out of the eight switches 58 are connected to three USB ports 56. Besides those three switches, another switch 58 is connected to the power socket 52, and the remaining four switches of the eight switches 58 are connected to the four middle layer jacks 38*a* respectively. It should be noted that the wirings shown in FIG. 3*c* are provided only to illustrate the connections between the middle layer jacks 38, 38*a*, the power socket 52, and the switches 58, but are not real fly lines. The above components are in fact connected together through internal wirings which are not exposed to the outside of the middle layer 22 in consideration of aesthetic appearance and safety.

The switches 58 are elements configured to switch on/off different electrical appliances or interfaces. For example, the switch 58 connected to the power socket 52 is adapted to control the power supply from the power socket 52, i.e., the switch is a power switch for the electrical appliance connected to the power socket 52. The switches 58 connected to the four middle layer jacks 38*a* are power switches for other electrical appliances. The control wirings of these electrical appliances can be arranged by exposed wirings or concealed wirings in the room and then connected to the modular socket panel via the bottom layer pins 30*a* and the back wiring terminals 50*a*, etc. The switches 58 connected to the USB ports 56 may be used to control the power supply (e.g., Vcc pin) to these USB ports 56. These switches 58 are not directly controlled by human hands. Instead, they can be controlled by other micro-electronic devices, for example relays.

Besides the switches 58, the middle layer 22 may further contain other functional components besides the power supply. For example, the middle layer may contain an environmental sensor, a network adapter, or a controller. These components can be connected via the opening 46 of the bottom layer 20 to different cables in the wall, such as network cable, telephone wire, TV cable, and speaker wire, etc. In FIG. 3*b*, a RJ45 network port 35 is shown. The RJ45 network port 35 can be connected to a network cable in the wall, so that the middle layer 22 can be used for connecting to a network or communicate with other network devices. The environmental sensor can be an infrared sensor, a human body sensor, an optical inductor, a temperature sensor or a humidity sensor, so that the modular socket panel can detect if there is any human activities in the room. Or the modular socket panel can acquire indoor environmental parameters, including luminance, humidity, temperature and the like, and send the parameters to a remote computer or other devices, to present the environmental information in the room to the user. The network adapter can be a powerline adapter that provides a network connection through electric wires, or an Ethernet access point or wireless access point, such as a Wi-Fi, Bluetooth, or NFC wireless access point. In case a wireless access point is provided, the middle layer 22 can further has an antenna for wireless signal transmission/receiving, such as a built-in antenna, or external rotatable or foldable antenna. The controller is adapted to receive the inputs generated by the switch operation of the modular socket panel therefore to control the operation of electrical appliances outside of the modular socket panel, for example, the controller can send RF control signals to other electrical appliances in the room so as to control the electrical appliances remotely. The environmental sensor, network adapter, or controller can be connected to the switches 58 so as to control the operation of the switches 58 and thereby accomplish the control of intelligent household electrical appliances.

Among the USB ports 56, two USB ports are on the bottom of the middle layer 22, and another USB port is on the surface of the middle layer 22. These USB ports 56 output DC power via an AC to DC converter (not shown) in the middle layer 22, such as a rectifier chipset, so as to charge a variety of handheld electronic devices connected to the USB ports 56. Additionally, these USB ports 56 can be connected to other components in the middle layer 22 to provide data connection function. Specifically, these USB ports 56 can be configured to connect the surface layer of the modular socket panel or other USB devices.

Figures 4A, 4B, 4C:
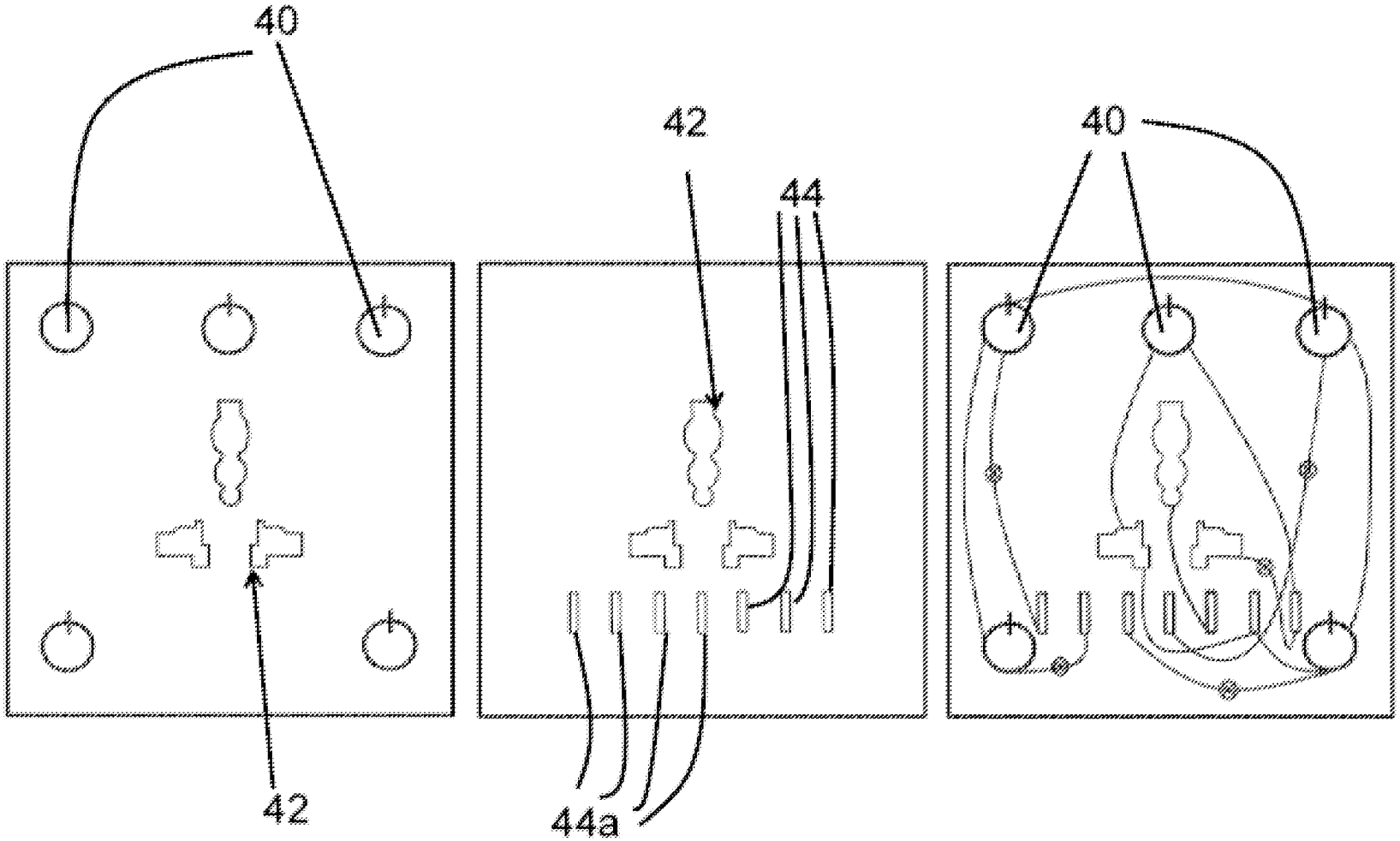
FIG. 4*a* is the front view of the surface layer in the modular socket panel shown in FIG. 1.
FIG. 4*b* is the rear view of the surface layer in the modular socket panel shown in FIG. 1.
FIG. 4*c* is a diagram illustrating the wiring of the surface layer in the modular socket panel shown in FIG. 1.

Now, look at the structure of the surface layer 24. Referring to FIG. 1, FIG. 4*a* and FIG. 4*b*, the surface layer 24 is a generally planar part including a plurality of surface layer pins 44, 44*a* arranged on the back side of the lower part of the surface layer 24. The surface layer pins 44 are respectively corresponding to the middle layer jacks 38 on the middle layer 22 or the bottom layer jacks 30 on the bottom layer 20. The surface layer pins 44*a* are respectively corresponding to the middle layer jacks 38*a* on the middle layer 22 or the bottom layer jacks 30*a* on the bottom layer 20. Here, the concept of the surface layer pins 44, 44*a* is similar to the concept of the bottom layer jacks 30, 30*a*. The surface layer pins 44 are respectively corresponding to the live wire, earth wire, and neutral wire of the mains power supply, so that the surface layer 24 obtains power supply and the power socket 42 obtains power supply. The surface layer pins 44*a* are control wirings configured to control other electrical appliances. In this embodiment, there are seven surface layer pins 44, 44*a* aligned in a line and spaced evenly. A plurality of switches 40 that can be operated by the user and a power socket 42 are arranged on the surface of the surface layer 24. As shown in the figures, there are five switches 40 designed to be controlled directly by human hands. For example, the switches 40 can be conventional mechanical switches, or they can be touch switches, e.g., the switches implement the control of inputs by means of capacitive or resistive induction. Thus, the user can control other electrical appliances in the room through the wiring among the surface layer 24, middle layer 22, and bottom layer 20 by controlling the switches 40 on the panel. The connections among the switches 40, power socket 42, and the surface layer pins 44, 44*a* are shown exemplarily in FIG. 4*c*. It should be noted that the wirings among the switches 40, power socket 42, and surface layer pins 44 shown in FIG. 4*c* are provided only to illustrate the connections among them, but are not real fly lines. The switches 40, power socket 42, and surface layer pins 44 are in fact connected through internal wires which are not exposed to the outside of the surface layer 24 in consideration of esthetic appearance and safety.

In addition, since the surface layer 24 is the outermost part of the modular socket panel and is directly placed in the residential environment, the surface layer 24 can be in color other than white, or have patterns, so as to be in tune with the interior decoration. For example, the surface layer 24 can have a colorful surface. The surface layer 24 can be in other diversified designs. For example, the dimension of the surface layer 24 (and the dimension of the middle layer) can be approximately 86 mm*86 mm when it is used with a common Type 86 embedded case. However, the surface layer 24 can be in other dimensions. For example, the surface layer 24 may have larger dimension, so that large decorative patterns can be printed on the surface layer 24. The surface layer 24 may have various shapes, such as round shape, diamond shape, triangular shape or the like, but not limited to the square shape of a conventional modular socket panel. The above said variant appearances of the surface layer do not affect the connection and mounting to the middle layer or the bottom layer, so the person skilled in the art can make variations to the appearance of the surface layer as required.

Next, the installation and operation of the modular socket panel in the above embodiment of the present invention will be described. Though the modular socket panel comprises three parts (a bottom layer, a middle layer, and a surface layer), the user can install all of the three parts or only install the bottom layer and surface layer where necessary. As shown in FIG. 1, in the case that all of the three parts are to be installed, the user firstly mounts the bottom layer 20 to an embedded case in the wall by connecting means, such as screws. As described above, such an embedded case can be an embedded case that is used together with a conventional socket panel in the art. In addition, the user must connect the electric wires led out from the embedded case to the bottom layer jacks 30 on the bottom layer 20. The control wirings for controlling other electrical appliances in the room should be connected to the bottom layer jacks 30*a*. In addition, other signal cables, such as network cable, telephone wire, TV cable, speaker wire and the like should be led in through the opening 46 of the bottom layer 20, so that the control wirings can be ready for connecting to the middle layer 22. After the bottom layer 20 is installed, the user only has to align the middle layer 22 to the bottom layer 20 in the above-mentioned pull and plug manner, in which the protrusion 34 is aligned to the cavity 32 and each middle layer pin 36 is aligned respectively to the corresponding bottom layer jack 30, and then plug the middle layer 22 onto the bottom layer 20. Then, the signal cables (e.g., network cable) can be directly inserted into the corresponding ports of the middle layer 22. Finally, the user only need to align the surface layer 24 to the middle layer 22, in which each surface layer pin 44 is aligned respectively to the corresponding middle layer jack 38, and then plug the middle layer 22 onto the surface layer 38 in a similar way. Therefore, the assembling of the modular socket panel is completed. Next, the user can plug the power plugs of the electrical appliances into the power socket 42, so that the electrical appliance can be used in a way similar to that in the case of a conventional socket panel in the prior art.

In addition, since the bottom layer, surface layer and middle layer of the modular socket panel disclosed in the present invention are electrically connected together via the bottom layer jacks, middle layer pins, middle layer jacks, surface layer pins and the like, any other elements in the middle layer would immediately obtain power and enter into an operating state after the middle layer is installed. For example, a Wi-Fi access point in the middle layer would start to transmit network signals, or temperature and humidity sensors in the middle layer would start their operations. At that time, the user can control the ON/OFF of the household electrical appliances by pressing or touching the switches on the surface layer. One of the benefits provided by the present invention is that the middle layer can be removed or replaced by the user without using any tool or requiring professional electrician's skills. The user can mount different middle layers in the modular socket panel as required to implement different functions, and the manufacturer can provide new middle layers for the users to choose as the market is developing. Thus, the functions of the modular socket panel can be expanded without replacing the entire modular socket panel, for example, adding more intelligent functions.

When the user wants to control the ON/OFF of other electrical appliance in the room during use, the user only has to manipulate the corresponding switches 40 on the control panel. Thus, the electrical appliances in the room will be controlled through the wiring among the surface layer 24, the middle layer 22, and the bottom layer 20. Moreover, the user can connect different electronic devices via the USB ports into the modular socket panel, so as to charge the electronic devices or carry out other data operations.

Figure 5:
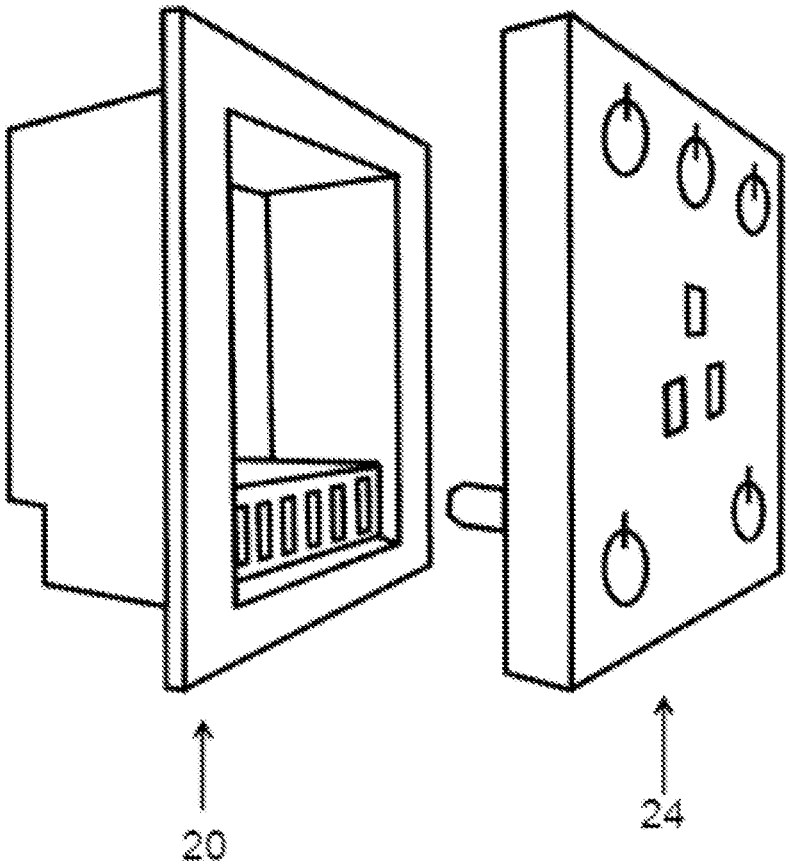
FIG. 5 is a diagram illustrating the assembly relationship of the modular socket panel according to an embodiment of the present invention, where the surface layer is directly coupled to the bottom layer.

In another embodiment, the user can choose not to install the middle layer. That is to say, the modular socket panel only includes the bottom layer and surface layer. Such an exemplary configuration is shown in FIG. 5. In the assembly process, the surface layer 24 is directly plugged onto the bottom layer 20 fixed to an embedded case in the wall, so that the surface layer pins are directly inserted into the bottom layer jacks. In this case, the modular socket panel doesn't have intelligent functions or communication functions originally provided by the middle layer; instead, the modular socket panel has become a simple power socket, just like a conventional socket panel. However, compared with socket panels in the art, the surface layer of the socket panel in the present invention can still be replaced freely, so as to create different types of decorative patterns on the surface or configure different types of power sockets. Since the middle layer and the surface layer can be plugged onto the bottom layer interchangeably in the present invention, and the surface layer can be stacked onto the middle layer and then plugged onto the bottom layer, the socket panel disclosed in the present invention is actually a modular design. Both the surface layer and the middle layer can be referred to as layer modules herein.

Figure 6:
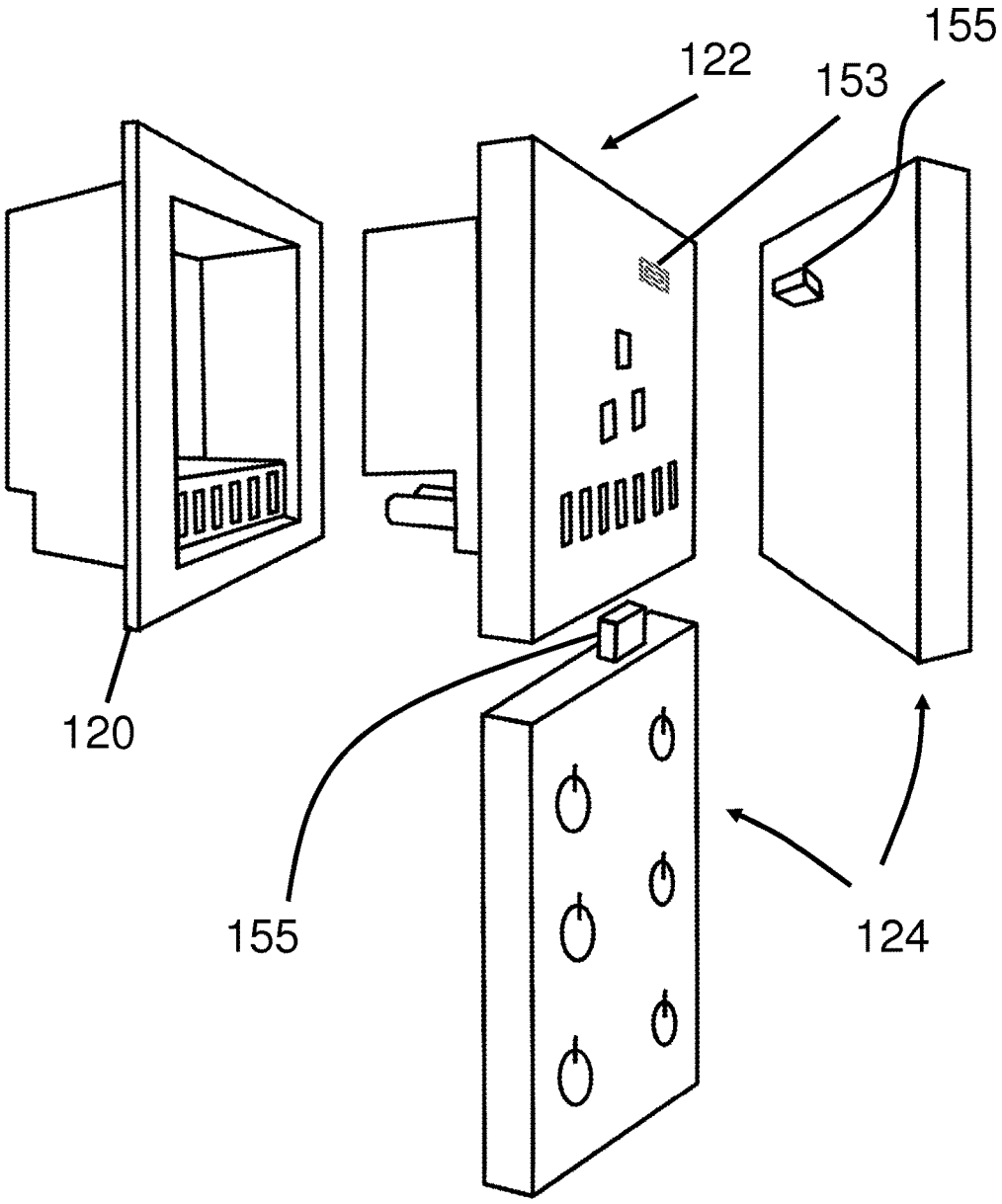
FIG. 6 is a diagram illustrating the assembly relationship of the modular socket panel according to an embodiment of the present invention, where the surface layer is coupled to the middle layer in a different direction.

In another embodiment of the present invention shown in FIG. 6, the bottom layer 120 and middle layer 122 of the modular socket panel, and different surface layers 124 that can work with the bottom layer 120 and the middle layer 122 are shown. Here, the bottom layer 120 and the middle layer 122 are similar to the bottom layer and middle layer shown in FIGS. 1-4*c*. But the surface layer 124 shown in FIG. 6 is different. In particular, the surface layer 124 is not mounted onto the middle layer 122 by directly plugging from the front side. Instead, the surface layer 124 is plugged into the middle layer 122 in a lateral direction. That is to say, the front side of the surface layer 124 and the front side of the middle layer 122 are parallel to each other and form a rectangular surface when the surface layer 124 is mounted. Here, the surface layer 124 is not connected to the middle layer jacks on the middle layer via the surface layer pins; instead, the surface layer 124 is connected to the middle layer 122 only via the USB interfaces. Two different surface layers 124 are shown in FIG. 6. One surface layer 124 has a USB plug 155 protruding from the back side thereof, while the other surface layer 124 has a USB plug 155 protruding from a side thereof. The two surface layers 124 can be mounted on the corresponding USB port 153 of the middle layer 122 separately. If required, the two surface layers 124 can be mounted on the same middle layer 122 at the same time as shown in the figure, so as to provide a larger control panel for the user. However, the person skilled in the art should appreciate that any other number of panels can be mounted on the middle layer as required.

Figure 7:
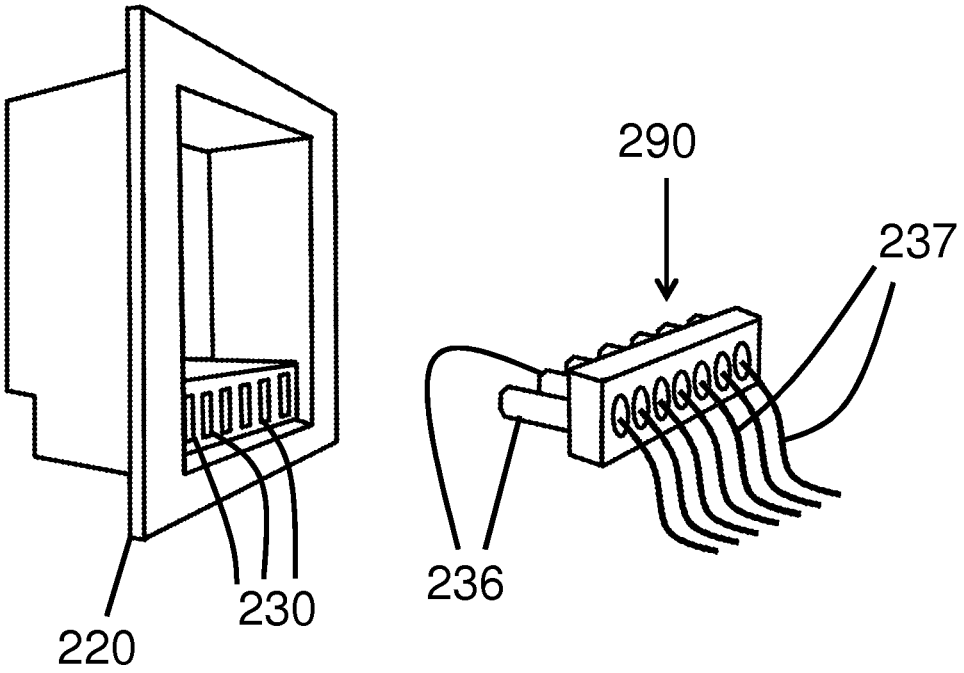
FIG. 7 is a diagram illustrating the assembly of the modular socket panel according to an embodiment of the present invention, where a separate connector base is mounted on the bottom layer jacks of the bottom layer.

In FIG. 7, a part of another modular socket panel disclosed in the present invention is shown, wherein, the bottom layer jacks 230 on the bottom layer 220 don't receive the middle layer pins of the middle layer or the surface layer pins of the surface layer. Instead, a separate circuit board 290 is plugged via circuit board pins 236 to the bottom layer jacks 230. At the other end of the circuit board 290, a plurality of wirings 237 corresponding to the bottom layer pins 230 are led out respectively. Such wirings 237 are configured to connect the bottom layer 220 to other devices external to the modular socket panel, such as separate switches or controllers, so that the control to the electrical appliances in the room can be flexibly achieved through the wiring of the bottom layer 220.

Hence, from the above description of some embodiments, those skilled in the art would realize that variations, substitute structures, and equivalences can be implemented without departing from the nature of the present invention. Accordingly, the above description should not be deemed as constituting any limitation to the scope of the present invention, which is only confined by the following claims.

For example, there are seven jacks/pins configured for inter-connection among the bottom layer, middle layer, and surface layer of the modular socket panel as described above, but the person skilled in the art should appreciate that the quantity is not the only possible configuration. The jacks/pins can be configured to be more or to be less as required. For example, more than seven jacks/pins can be configured to provide more electrical connections, or less than seven jacks/pins can be configured.

In addition, the components included in the middle layer in the above embodiments include, for example environmental sensor, network adapter, controller and the like, but the components are not limited to those examples. The person skilled in the art can deploy other components in the middle layer as required, so as to implement control of various intelligent household electrical appliances or provide an electronic communication function, etc.

Moreover, the power socket provided on the modular socket panel in the above embodiments is a British standard three-jack socket, but it can be configured into a different type of power socket, such as a Chinese standard socket, American standard socket, or European standard socket, etc.

The surface layer, the middle layer and/or the bottom layer of the modular socket panel shown in FIGS. 1-7 are inter-connected in a pull and plug manner. It should nonetheless be appreciated that other types of installation are also possible. For example, a protruding fixed base is arranged on one of these parts, and a snap is arranged on one another part, so that the two parts can be connected together in a snap-fitted manner. Or, a sliding channel is arranged on one of these parts, and a protruding sliding piece is arranged on one another part, so that the two parts can be fixed and connected in a slide manner. Both the snap-fitting means and the sliding means described above are only exemplary. The person skilled in the art should appreciate that other similar connecting structures are also possible, and all these connecting means have a common characteristic, i.e., all of them don't require any additional fastener such as screws, and don't require any special tool to fix two panels together. This is an important distinguishing characteristic of the present invention when compared with the prior art. The above installation means can be generally referred to as a non-fastening manner.

Finally, the surface layer and the middle layer of the modular socket panel shown in the above embodiments are preferably in 86 mm*86 mm dimension. However, the dimension of the surface layer and middle layer can be designed to other common standard dimension as required in other applications, such as 120 mm*60 mm or 120 mm*120 mm.

The invention claimed is:

1. A modular socket panel, comprising:

a bottom layer adapted to be fixed to an embedded case in a wall and adapted to electrically connect to a power supply provided by the embedded case;

a middle layer disposed between the bottom layer and the surface layer; the middle layer adapted to connect to the bottom layer in a non-fastening manner;

a surface layer adapted to be directly or indirectly connected to the bottom layer by a non-fastening manner; the surface layer adapted to connect to the middle layer in a non-fastening manner;

wherein, the surface layer provides a power socket, which is electrically connected to the bottom layer;

wherein the middle layer is electrically connected to the bottom layer and the surface layer respectively; and wherein the bottom layer has a plurality of bottom layer jacks, all of which are connected to the power supply provided by the embedded case; the middle layer having a plurality of middle layer pins that are respectively corresponding to and electrically connected to the bottom layer jacks, and a plurality of middle layer jacks connected to the middle layer pins; the surface layer having a plurality of surface layer pins that are respectively corresponding to and electrically connected to the middle layer jacks.

2. The modular socket panel according to claim 1, wherein the middle layer is provided with at least one of the following components: an environmental sensor, a network adapter and a controller.

3. The modular socket panel according to claim 2, wherein the environmental sensor is selected from one of the following sensors: a temperature sensor, a humidity sensor, an infrared sensor, a human body sensor, and a light sensor.

4. The modular socket panel according to claim 2, wherein the network adapter is a powerline adapter, an Ethernet adapter, or a wireless access point.

5. The modular socket panel according to claim 2, wherein the controller is adapted to connect with switches disposed on the surface layer, and receive the inputs generated by operations on the switches, therefore control the operation of electrical appliances external to the modular socket panel.

6. The modular socket panel according to claim 1, wherein, the bottom layer is directly connected to the surface layer, the surface layer having a plurality of middle pins that are respectively corresponding to and electrically connected to the bottom layer jacks.

7. The modular socket panel according to claim 1, wherein the power socket is a USB socket, which is connected to the bottom layer via an AC to DC converter.

8. The modular socket panel according to claim 1, wherein the bottom layer is adapted to be fixed to the embedded case in the wall by screws.

9. The modular socket panel according to claim 1, wherein a surface of the surface layer is colored.

10. The modular socket panel according to claim 1, wherein a front side of the surface layer is in a polygonal, round, or irregular shape.

11. The modular socket panel according to claim 1, wherein the non-fastening manner includes sliding, pull and plug, or snap-fitting.

* * * * *